US010625433B2

(12) United States Patent
Gratsias et al.

(10) Patent No.: US 10,625,433 B2
(45) Date of Patent: Apr. 21, 2020

(54) RAZOR HANDLE COMPRISING AN INSERT FREELY MOVABLE WITHIN A CAVITY AND RAZOR COMPRISING SUCH A RAZOR HANDLE

(71) Applicant: BIC-VIOLEX SA, Anixi, Attiki (GR)

(72) Inventors: Spiros Gratsias, Kipseli-Athens (GR); Ioannis-Marios Psimadas, Vrilissia-Athens (GR)

(73) Assignee: BIC-VIOLEX SA, Anixi (GR)

( * ) Notice: Subject to any disclaimer, the term of this patent is extended or adjusted under 35 U.S.C. 154(b) by 262 days.

(21) Appl. No.: 15/322,782

(22) PCT Filed: Aug. 4, 2014

(86) PCT No.: PCT/EP2014/066734
§ 371 (c)(1),
(2) Date: Dec. 29, 2016

(87) PCT Pub. No.: WO2016/019975
PCT Pub. Date: Feb. 11, 2016

(65) Prior Publication Data
US 2017/0129116 A1 May 11, 2017

(51) Int. Cl.
*B26B 21/52* (2006.01)
*B26B 21/22* (2006.01)

(52) U.S. Cl.
CPC ..... *B26B 21/522* (2013.01); *B26B 21/225* (2013.01); *B26B 21/52* (2013.01); *B26B 21/528* (2013.01)

(58) Field of Classification Search
CPC ..... B26B 21/52; B26B 21/522; A61H 7/003; A61H 7/005; A61H 15/0085; A61H 15/0092; A61H 2201/0153; A61H 2205/021; A61H 2205/022
USPC .... 30/41, 41.5, 47–51, 526–536; D28/46–48
See application file for complete search history.

(56) References Cited

U.S. PATENT DOCUMENTS 1,455,726 A * 5/1923 Hartman ..... B26B 21/52 30/529
1,455,750 A 5/1923 Hartman
2,189,689 A * 2/1940 Thompson ..... B26B 21/52 30/526
2,264,323 A * 12/1941 Monnet ..... B26B 21/18 30/526
D143,326 S * 12/1945 Kempf ..... D28/48
2,794,246 A * 6/1957 Marsh et al. ..... B26B 21/06 D28/46
3,413,720 A * 12/1968 Mullen ..... B26B 21/06 D28/46
D216,658 S * 2/1970 Edmondson ..... D28/46
(Continued)

OTHER PUBLICATIONS

International Search Report of PCT/EP2014/066734 dated Sep. 9, 2014.

*Primary Examiner* — Jason Daniel Prone
(74) *Attorney, Agent, or Firm* — Polsinelli PC

(57) ABSTRACT

A razor handle includes an elongated body extending in a longitudinal direction and has an outer surface. The outer surface of the handle is provided with a cavity. The cavity includes a first end and a second end and is open between the first and second ends. The razor handle further includes an insert, shaped to move freely within the cavity between the first and second ends.

24 Claims, 11 Drawing Sheets

(56) References Cited

U.S. PATENT DOCUMENTS 3,583,262 A * 6/1971 Mullen ..... B26B 21/06 D28/46
D250,130 S * 10/1978 Douglas ..... D28/46
D253,726 S * 12/1979 Schuman ..... D28/46
4,212,103 A 7/1980 Schuman-Hoole
D259,065 S * 4/1981 Byrne ..... D28/46
D268,291 S * 3/1983 Jones ..... D28/48
4,484,744 A * 11/1984 Gmunder ..... A63F 9/0857 273/153 S
4,509,756 A * 4/1985 Moscovich ..... A63F 9/0823 273/153 S
4,535,537 A * 8/1985 Ferraro ..... B26B 21/06 30/47
4,635,361 A * 1/1987 DeMars ..... B26B 21/446 30/41
4,653,188 A * 3/1987 Kwak ..... B26B 21/446 30/41
4,716,652 A * 1/1988 Cataudella ..... B26B 21/446 30/535
D295,795 S * 5/1988 Demars ..... B26B 21/446 D28/46
4,749,284 A * 6/1988 Teramachi ..... F16C 29/0642 384/45
4,753,006 A * 6/1988 Howe ..... B26B 21/446 30/535
4,760,642 A * 8/1988 Kwak ..... A46B 11/0024 30/41
D304,773 S * 11/1989 Beuchat ..... D28/46
4,914,819 A * 4/1990 Ash ..... A47G 21/02 30/141
D344,365 S * 2/1994 Mondo ..... B26B 21/446 D28/46
5,337,478 A * 8/1994 Cohen ..... B26B 21/446 30/41
5,449,175 A * 9/1995 Nagy ..... A63F 9/0857 273/153 S
5,664,330 A * 9/1997 DeMars ..... B26B 21/446 30/41
5,735,050 A * 4/1998 Hsieh ..... A47G 21/04 30/324
D403,113 S * 12/1998 Kohring ..... D28/48
7,007,389 B1 * 3/2006 Arif ..... A45D 34/04 30/41
D540,984 S * 4/2007 Psimadas ..... F16C 29/0642 D28/48
D612,540 S * 3/2010 Joslin ..... D28/48
7,779,543 B2 * 8/2010 Wang ..... B26B 21/40 30/50
7,788,809 B2 * 9/2010 Tomassetti ..... B26B 21/446 30/535
D668,816 S * 10/2012 Psimadas ..... D28/48
8,365,416 B2 * 2/2013 Rockell ..... B26B 21/446 30/41
9,095,986 B2 * 8/2015 Psimadas ..... B26B 21/222
D763,506 S * 8/2016 Barrett ..... D28/46
9,731,427 B2 * 8/2017 Gratsias ..... B26B 21/225
2004/0252925 A1 * 12/2004 Gotoh ..... F16C 33/416 384/528
2005/0011072 A1 1/2005 Segrea
2005/0198841 A1 9/2005 Worrick, III
2006/0272154 A1 * 12/2006 Brevard ..... B26B 21/446 30/41
2010/0107415 A1 * 5/2010 Kurzet ..... B26B 21/446 30/41
2017/0165854 A1 * 6/2017 Gratsias ..... B26B 21/225
2018/0311848 A1 * 11/2018 Gratsias ..... B26B 21/528

* cited by examiner

RAZOR HANDLE COMPRISING AN INSERT FREELY MOVABLE WITHIN A CAVITY AND RAZOR COMPRISING SUCH A RAZOR HANDLE

FIELD OF INVENTION

The invention relates to razor handles and razors.

BACKGROUND OF THE INVENTION

More precisely, the invention relates to a razor handle comprising an elongated body extending in a longitudinal direction, said elongated body having an outer surface and being provided with a cavity opening on said outer surface and extending between a first end and a second end, said razor handle further comprising a first insert.

US 2010107415 discloses an example of such a known razor handle comprising a shaving lubricant dispenser and asphere movably positioned in a cavity that stores a shaving lubricant, the sphere being adapted for moving the shaving lubricant from the cavity out of the razor handle. Besides, the sphere moves and rotates in tandem with a pusher and a slider both provided on the razor for pushing the shaving lubricant.

However, the insert does not change the relative weight of the razor handle according to the shaving position.

SUMMARY OF THE INVENTION

One objective of the present invention is to avoid this drawback. Another objective is to improve the shaving with a razor handle according to the invention.

These objectives are solved by the fact that, according to the invention, the cavity has a shape allowing 30 the first insert to move freely within the cavity between the first and second ends of said cavity.

Thanks to the insert, the razor handle can have a proper weight improving the handle's effect on shaving depending on its relative orientation within the cavity. The weight of the handle perceived by the user thus varies according to the shaving positions.

Furthermore, it is possible to increase significantly the weight of the razor handle thanks to the insert. As a consequence, it is unnecessary to increase the volume of the razor handle to this end. For instance, in the case that the handle is made of a plastic material, less plastic will be required to attain a greater weight due to the presence of the insert within the cavity.

In advantageous embodiments of such a razor handle, one and/or the other of the following features may be incorporated:

- the first insert has a position which is comprised between the first and second ends, said position depending on the orientation of said razor handle;
- the elongated body is a unitary element which comprises a material chosen among the plastics, the metals and the rubbers;
- the first insert is made of a rigid material having a density that is different from the density of the material of the elongated body;
- the first insert comprises a material chosen among the metals, the plastics and the rubbers;
- the cavity extends in the longitudinal direction, said cavity having a length measured along said longitudinal direction comprised between 30 mm and 120 mm;

- the cavity extends in the longitudinal direction, said cavity having a length measured along said longitudinal direction comprised between 10% and 90% of the length of the razor handle;
- the cavity has a width measured in a direction perpendicular to the longitudinal direction comprises between 5 and 15 mm;
- the cavity has a width measured in a direction perpendicular to the longitudinal direction comprised between 50% and 80% of the smallest width of the elongated body,
- the razor handle extends between a front end and a rear end, the rear end being opposite the front end, said front end being provided with connecting means for connection to a shaving cartridge, the first end being located in the vicinity of said front end, whereas the second end is located in the vicinity of said rear end;
- the first end is located at a distance measured along the longitudinal direction of about 30 mm from the front end;
- the first end is located at a distance measured along the longitudinal direction comprised between 5% and 30% of the length of the razor handle;
- the second end is located at a distance measured along the longitudinal direction of about 10 mm from the rear end;
- the second end is located at a distance measured along the longitudinal direction comprised between 5% and 15% of the length of the razor handle;
- the first insert is a sphere which has a diameter comprised between 5 mm and 20 mm;
- the first insert is a sphere which has a diameter measured in a direction perpendicular to the longitudinal direction comprised between 40% and 80% of the smallest width of the elongated body;
- the first and second ends respectively comprise a semi-spherical shape having a diameter comprised between 5 and 20 mm;
- the first and second ends respectively comprise a semi-spherical shape having a diameter measured in a direction perpendicular to the longitudinal direction comprised between 40% and 90% of the smallest width of the elongated body;
- the elongated body has an upper face and a lower face, the lower face being opposite the upper face, the cavity extending between said upper and lower faces and opening all along said upper and lower faces between the first and second ends;
- the cavity forms an upper opening and a lower opening respectively along the upper and lower faces, said upper and lower openings respectively having a width in a direction perpendicular to the longitudinal direction which is smaller than the size of the first insert;
- the cavity comprises a first interior wall extending in the longitudinal direction inside said cavity;
- the first interior wall has a shape that is partly complementary to the shape of the first insert, so that said first insert is partially encapsulated within said cavity;
- the razor handle comprises a second insert and a third insert, said second and third inserts being maintained within the cavity respectively in the first and second ends;
- the second insert is immovable within the cavity, said immovable second insert forming a finger rest area;
- the second insert is movable within the cavity;
- the third insert forms a finger rest area;

the first, second and third inserts are spheres which have a diameter comprised between 5 and 20 mm;

the first, second and third inserts are spheres which have a diameter measured in a direction perpendicular to the longitudinal direction comprised between 40% and 80% of the smallest width of the elongated body;

the second and third inserts respectively have a diameter which is greater than the diameter of the first insert;

the first interior wall of the cavity is smooth and does not prevent the first insert from moving within the cavity; and the first interior wall of the cavity is provided with zones having frictional resistance with the first insert.

The invention also concerns a razor comprising such a razor handle and a shaving cartridge connected to said razor handle.

The above and other objects and advantages of the invention will become apparent from the detailed description of one embodiment of the invention, considered in conjunction with the accompanying drawings.

DETAILED DESCRIPTION OF THE DISCLOSURE

In the various figures, the same references denote identical or similar elements.

Figure 1A:
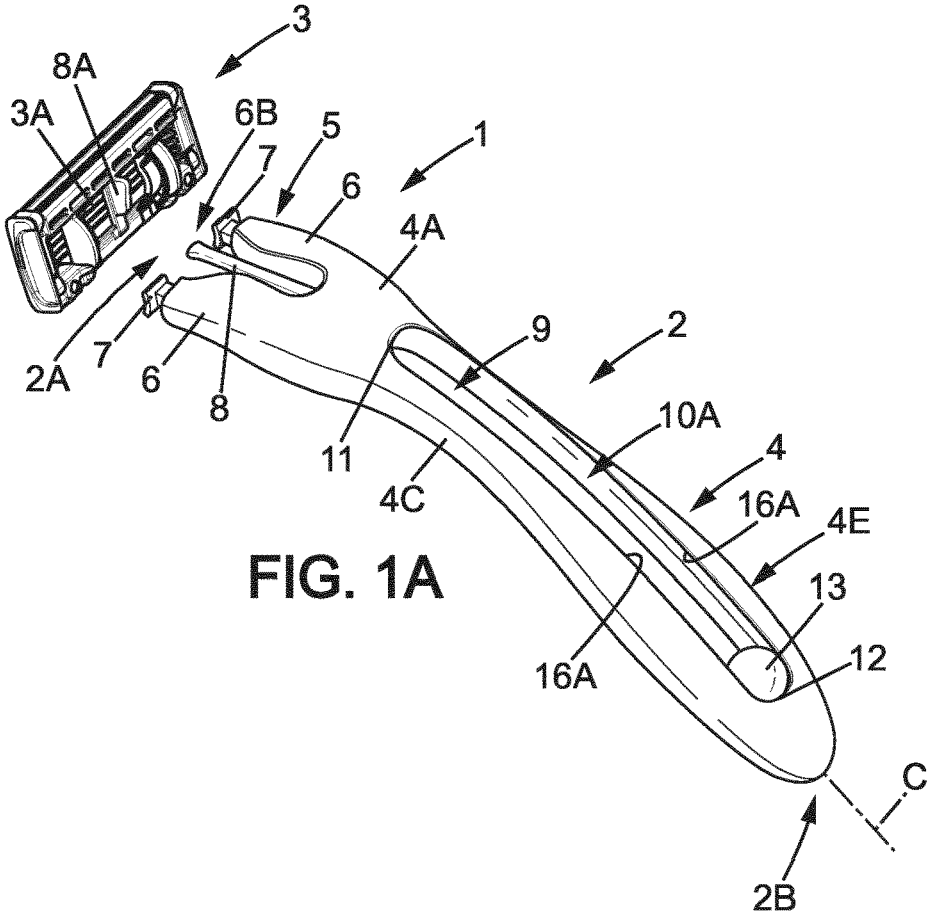
FIGS. 1A and 1B are perspective views of a razor in two different positions according to the invention comprising a razor handle and a shaving cartridge.
Figure 1B:
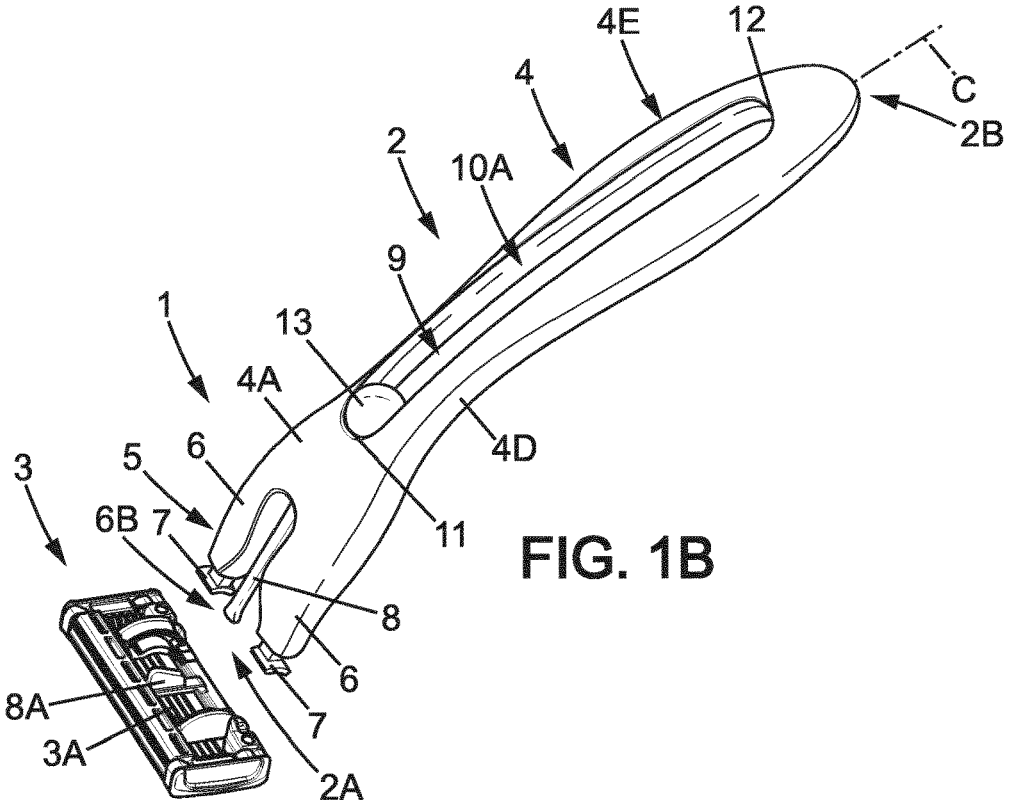

FIGS. 1A and 1B illustrates a wet shaving razor 1. The present invention comprises a razor handle 2 and a shaving cartridge 3. The shaving cartridge 3 is preferably a disposable shaving cartridge, comprising one or several blades 3A, which can be connected to or released from the razor handle 2 as shown on FIGS. 1A and 1B. The shaving cartridge 3 may also be pivotal relative to the razor handle 2.

The razor handle 2 has a generally curved shape and extends in a longitudinal direction C between a front end 2A and a rear end 2B, the rear end 2B being opposite the front end 2A. The razor handle 2 also has an elongated body 4 for hand grasping the razor handle 2, extending longitudinally from the rear end 2B to an end near the front end 2A.

The razor further comprises connecting means 5 in the continuation of the elongated body 4 up to the front end 2A. In other words, the elongated body 4 extends longitudinally from the rear end 2B to the beginning of the connecting means 5. The shaving razor 1 extends longitudinally from the rear end 2B to the free end of the connecting means 5, the free end being the one to be connected to the shaving cartridge 3.

Figure 2A:
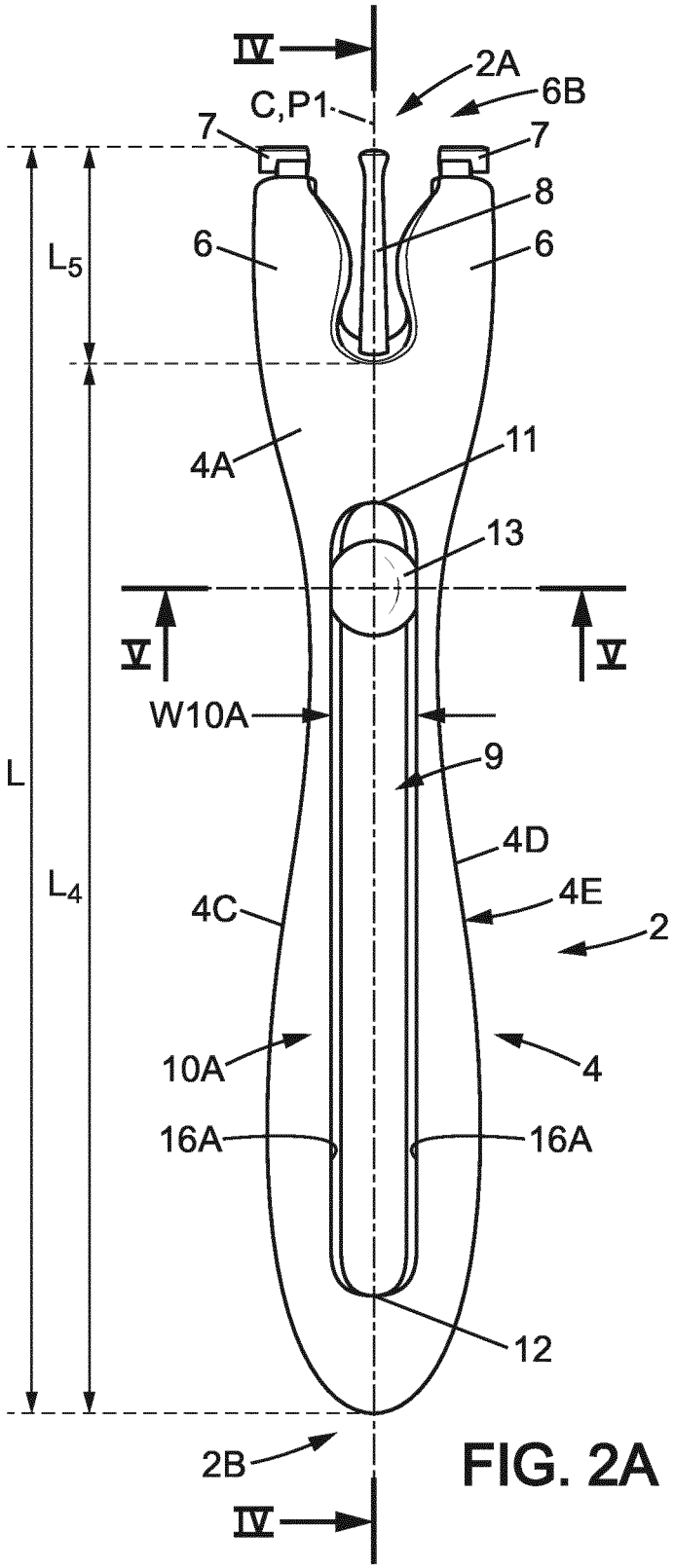
FIGS. 2A and 2B are respectively an upper view and a lower view of the razor handle of FIGS. 1A and 1B in another position.
Figure 2B:
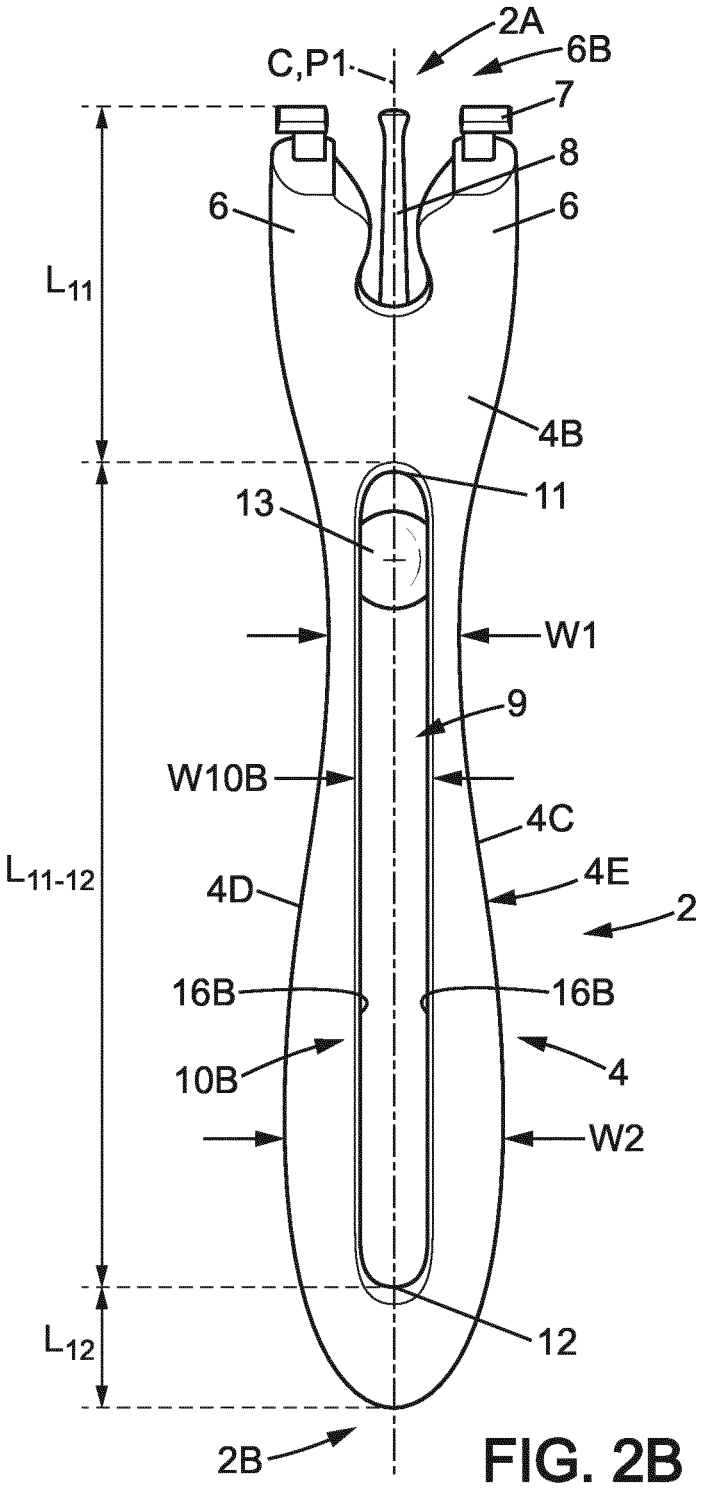

Referring to FIGS. 2A and 2B, it can be seen that the razor handle 2 can be symmetrical with respect of a median plane P1 and has a length L in the longitudinal direction C. The length L4 of the elongated body 4 measured along the longitudinal direction C can be comprised between 70% and 90% of the length L of the razor handle 2. The length L5 of the connecting means 5 measured along the longitudinal direction C can be comprised between 10% and 20% of the length L of the razor handle 2. For instance, the length L in the longitudinal direction C can be comprised between 80 and 200 mm, preferably between 100 mm 5 and 150 mm, and more preferably about 125 mm. The length L4 of the elongated body 4 is about 100 mm to about 120 mm, whereas the length L5 of the connecting means 5 is about 10 to 30 mm. For instance, the length L may be of about 125 mm whereas the length L4 may be of about 108 mm and the length 10 L5 may be of about 22 mm.

Figure 3A:
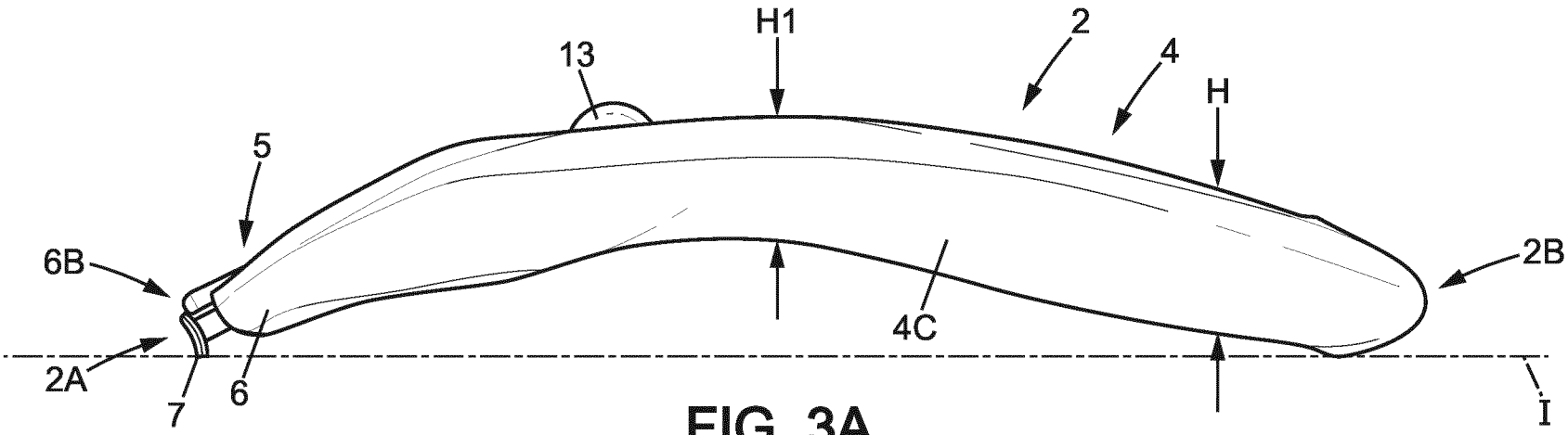
FIGS. 3A, 3B and 3C are side views of the razor handle of FIGS. 2A and 2B respectively in three different positions.
Figure 3B:
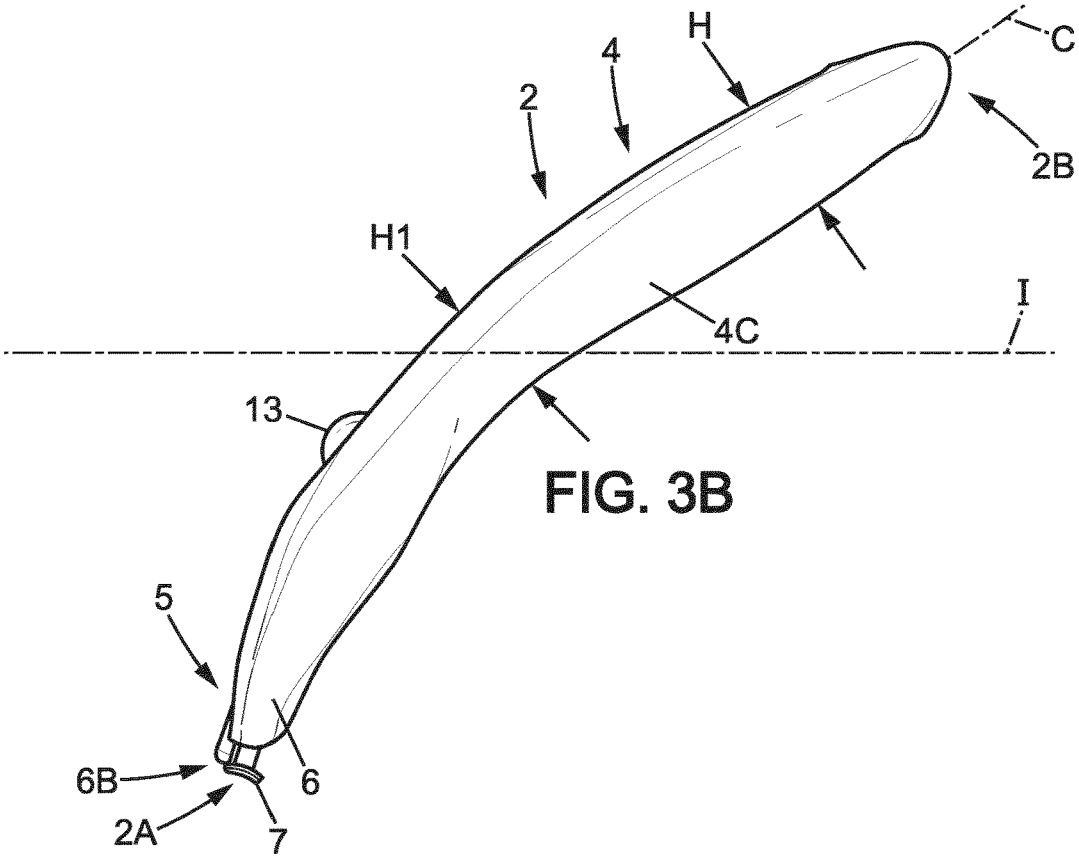
Figure 3C:
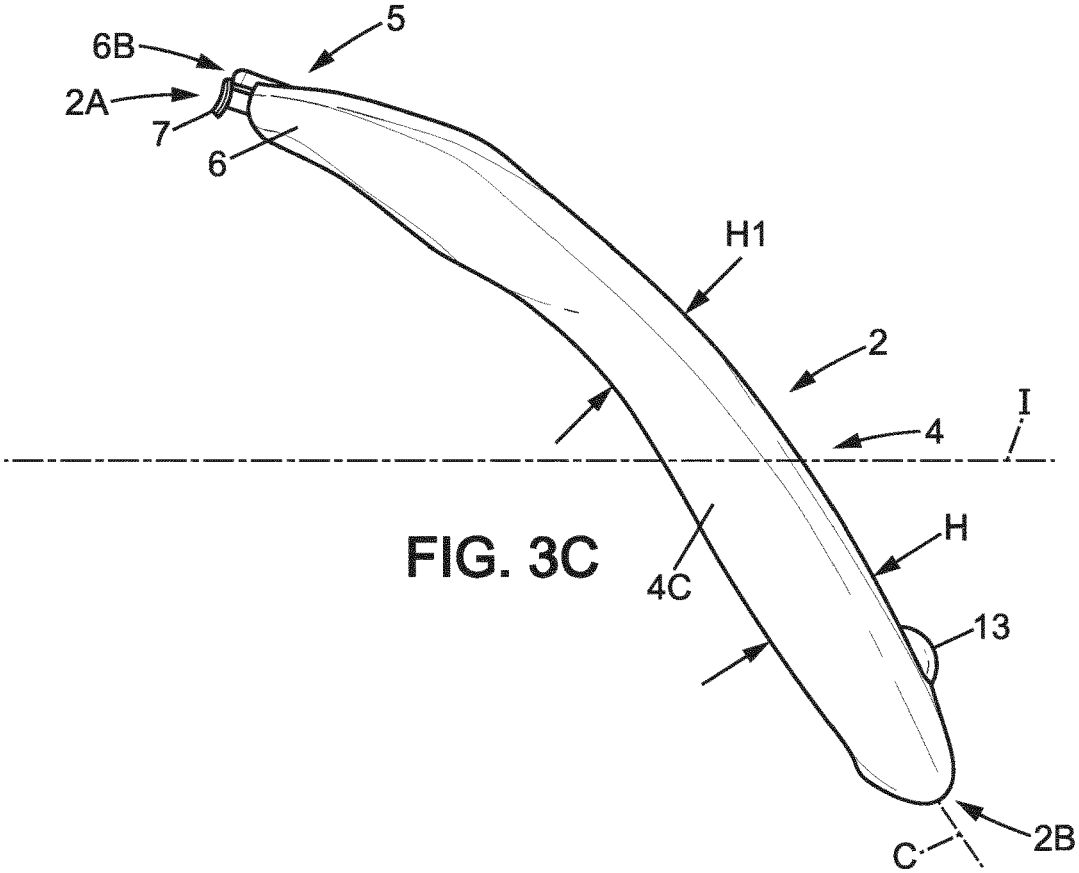

The razor handle 2 may also define a variable height H and a width W along the length L thereof. The height H of the razor handle 2 may vary along the direction C but is preferably comprised between 15 mm and 25 mm, preferably about 20 mm. As depicted in FIG. 3A-3C, the smallest height H1 of the elongated body 4 is located about the center of the razor handle 2. However, the smallest height H1 may be located elsewhere on the razor handle 2 depending on its shape.

The width W of the razor handle 2 may as well vary along the direction C but is preferably comprised between 10 mm and 25 mm, preferably about 20 mm. As depicted in FIG. 2B, the smallest width W1 of the elongated body 4 is also located about the center of the razor handle 2.

However, the smallest width W1 may be located elsewhere on the razor handle 2 depending on its shape.

The elongated body 4 has an enlarged part located in the vicinity of the rear end 2B of the razor handle 2 having a width W2 which is maximized.

The connecting means 5 can be integral with the elongated body 4. The connecting means 5 can comprise two flexible arms 6 extending from the elongated body 4 and protruding toward a free end 6B at the front end 2A of the razor handle 2. In other words, the flexible arms 6 and the elongated body 4 are unitary.

Besides, the razor handle 2 may comprise a lock and release mechanism. In particular, the arms 6 may be flexed by a user thanks to this lock and release mechanism to attach or release the shaving cartridge 3 from the razor handle 2.

As depicted on FIGS. 2A and 2B, each of the two arms 6 may be provided, at the free end 6B, with a bearing structure 7 for connection to the shaving cartridge 3. In the disclosed embodiments, the shaving cartridge 3 is of the pivotal type, the bearing structures 7 allowing the pivoting of the shaving cartridge 3 when connected to the razor handle 2, whereas a longitudinal flexible tongue 8, extending between the arms 6 and cooperating with a groove 8A formed on the shaving cartridge 3, provides a spring force which biases the shaving cartridge 3 towards a rest position. However, the shaving cartridge 3 may also be fixed relatively to the razor handle 2.

The elongated body 4 has an outer surface 4E. More precisely, the elongated body 4 has an upper face 4A and a lower face 4B as depicted on FIGS. 2A and 2B, the lower face 4B being opposite the upper face 4A. The elongated body 4 further has two lateral sides 4C, 4D comprised between the upper and lower faces 4A, 4B, opposite each other and also extending in the longitudinal direction C.

The elongated body 4 and the connecting means 5 can form a unitary element. The elongated body 4 and the connecting means 5 can be moulded out of a material during a single step of a manufacturing process. Preferably, the elongated body 4 and the connecting means 5 are moulded out of the same material. The material may be any mouldable material. Preferably, the material is chosen among the plastics, the metals, such as metal alloys, and the rubbers. For instance, the elongated body 4 and the connecting means 5 can be molded in a thermoplastic material, for instance in acrylonitrile butadiene styrene (ABS) or in polypropylene (PP).

The elongated body 4 further includes a cavity 9 which extends along the longitudinal direction C. The cavity 9 preferably extends between the upper face 4A and the lower face 4B of the elongate body 4. However, the cavity 9 may also extend between the lateral sides 4C, 4D of the elongated body 4. The cavity 9 may be a blind hole that opens on the outer surface 4E of the elongated body 4. In particular, the cavity 9 may be a blind hole that opens on the upper face 4A or on the lower face 4B.

Figure 4:
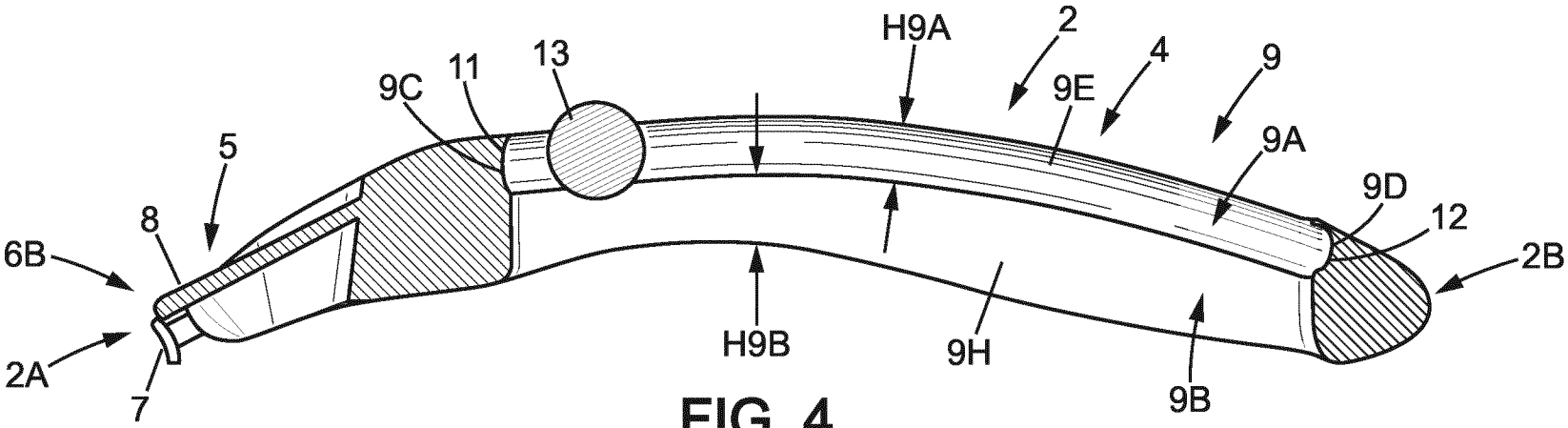
FIG. 4 is a section of the razor handle shown in FIG. 2A along line IV-IV.

The cavity 9 may also be a through hole as illustrated on FIG. 4. The cavity 9 can open on the upper face 4A and on the lower face 4B of the elongated body 4. The cavity 9 thus defines an upper opening 10A and a lower opening 10B respectively on the upper face 4A and on the lower face 4B of the elongated body 4. The upper and lower openings 10A, 10B have an elongated shape when seen on the upper view or on the lower view of the razor handle 2 depicted in FIGS. 2A and 2B. The upper and lower openings 10A, 10B may respectively have parallel, preferably straight, walls 16A, 16B extending longitudinally along the direction C between a first and second ends 11, 12. As depicted on FIGS. 2A and 2B, the free ends of the walls 16A, 16B delimit the opening of the cavity 9 respectively on the upper and lower faces 4A, 4B.

The cavity 9 extends in the longitudinal direction C between the first end 11 and a second end 12. More particularly, the cavity 9 opens all along the upper and lower faces 4A, 4B between the first and second ends 11,12. The first end 11 can be located in the vicinity of the front end 2A. The second end 12 can be located in the vicinity of the rear end 2B. The ends of the upper and lower openings 10A, 10B are located respectively at the first and second ends 11, 12. The ends of the openings 10A, 10B can have rounded shapes as it can be seen on FIGS. 2A and 2B. Preferably, the first end 11 is located at a distance L11 measured along the longitudinal direction C from the front end 2A. The distance L11 may be comprised between 5% and 30% of the length L of the razor handle 2 in the longitudinal direction C. For instance, the distance L11 can be of about 30 mm from the front end 2A. The first end 11 may also be located at a distance L11 of less than 30 mm from the front end 2A. More particularly, the distance L11 may be comprised between 5% and 15% of the length L of the razor handle 2 in the longitudinal direction C. The second end 12 is located at a distance L12 measured along the longitudinal direction C from the rear end 2B. The distance L12 may be comprised between 5% and 15% of the length L of the razor handle 2 in the longitudinal direction C. The distance L12 may be comprised between 5 mm and 20 mm from the rear end 2B. Also, the second end 12 may also be located at a distance L12 of less than 10 mm from the rear end 2B. Preferably, the second end 12 is located at a distance L12 of about 10 mm from the rear end 2B. The distance L11-12, which also corresponds to the length of the cavity 9 measured along the longitudinal direction C, is comprised between 30 mm and 120 mm, preferably between 60 mm and 90 mm. As an alternative, the distance L11-12 is comprised between 10% and 90% of the length L of the razor handle 2 in the longitudinal direction C. More particularly, the distance L11-12 may be comprised between 60% and 70% of the length L of the razor handle 2 in the longitudinal direction C. For instance, the distance L11-12 may be of about 85 mm.

The cavity 9 also has a width W9 measured in a direction perpendicular to the longitudinal direction C.

The width W9 may be comprised between 50% and 80% of the smallest width W1 of the elongated body 4. For instance, the width W9 can be comprised between 5 and 15 mm. For instance, the smallest width W1 may be of about 13 mm whereas the width W9 may be of about 10 mm.

As illustrated for instance on FIG. 4 which is a section view of the razor handle 2 according to the plane P1, the cavity 9 comprises an upper part 9A and a lower part 9B in communication with each other and both extending along the longitudinal direction C between the first end 11 and the second end 12. The upper part 9A is located between the upper face 4A and the lower part 9B. The lower part 9B of the cavity is located between the upper part 9A and the lower face 4B.

The upper part 9A of the cavity 9 has a height H9A.

The height H9A is preferably constant. The height H9A may be comprised between 40% and 100% of the smallest height H1 of the elongated body 4. For instance, the height H9A is constant and is comprised between 5 and 15 mm. The lower part 9B of the cavity 9 has a height H9B. This height H9B can vary along the length of the cavity. The height H9B may be comprised between 0% and 80% of the smallest height H1 of the elongated body 4. For instance, the height H9B can be variable and can be comprised between 10 and 20 mm. For instance, the smallest height H1 may be of about 13 mm, whereas the height H9A may be of about 7 mm and the height H9B may be of about 6 mm.

The upper part 9A comprises a first interior wall 9E extending in the longitudinal direction C. The first interior wall 9E delimits an interior space of the upper part 9A of the cavity 9 comprised inside the elongated body 4 between the upper face 4A and the lower part 9B. The first interior wall 9E further comprises two semi-spherical shapes 9C, 9D at each end of the upper part 9A, and more precisely respectively at the first and second ends 11, 12. The two semi-spherical shapes 9C, 9D may have respectively a diameter D11, D12 measured in a direction perpendicular to the longitudinal direction C which is comprised between 40% and 80% of the smallest width W1 of the elongated body 4. For instance, the two semi-spherical shapes 9C, 9D respectively have a diameter D11, D12 comprised between 5 mm and 20 mm. For instance, the smallest width W1 may be 20 of about 13 mm whereas the diameters D11, D12 may respectively be of about 10 mm.

Figure 5:
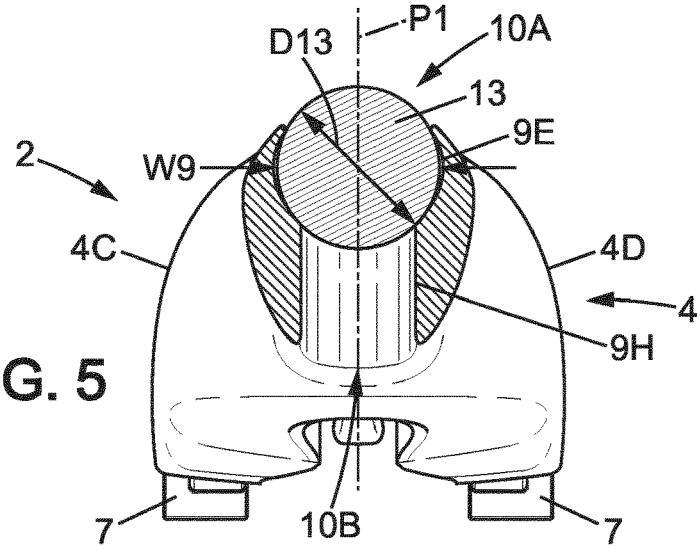
FIG. 5 is a section of the razor handle shown in FIG. 2A along line V-V.
Figure 6A:
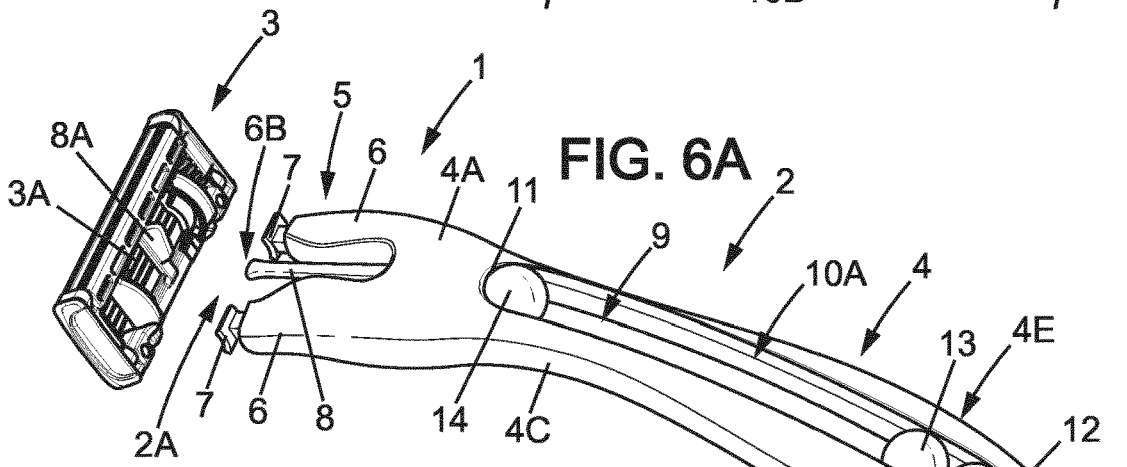
FIGS. 6A and 6B are perspective views of a razor in two different positions according to another embodiment of the invention comprising a razor handle and a shaving cartridge.
Figure 6B:
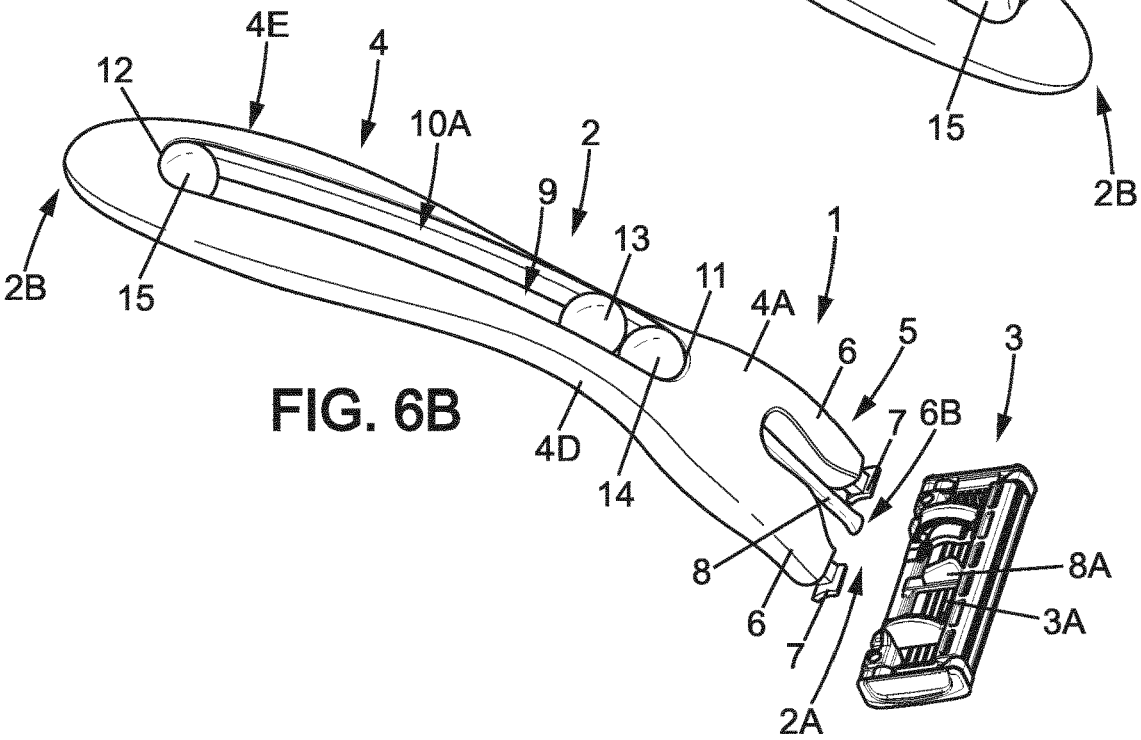
Figure 7A:
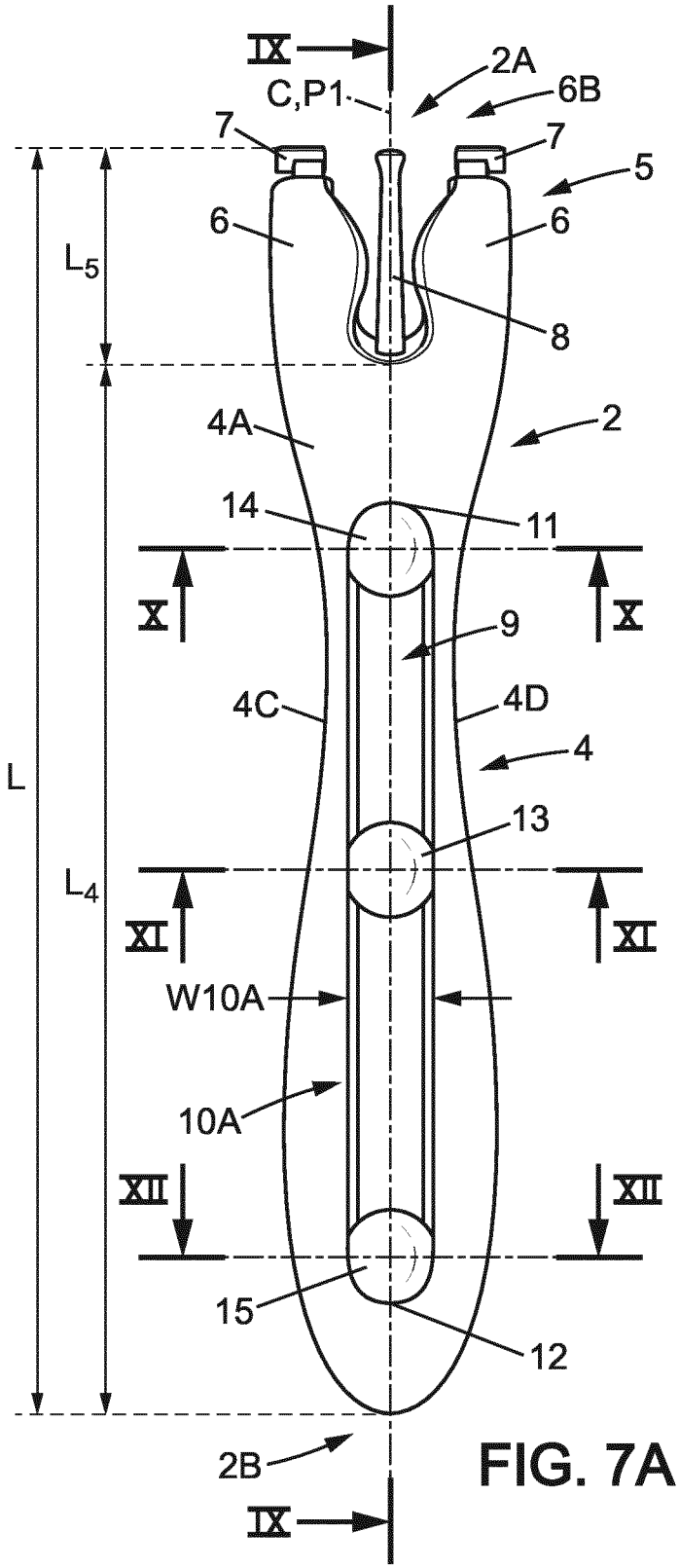
FIGS. 7A and 7B are respectively an upper view and a lower view of the razor handle of FIGS. 6A and 6B in another position.
Figure 7B:
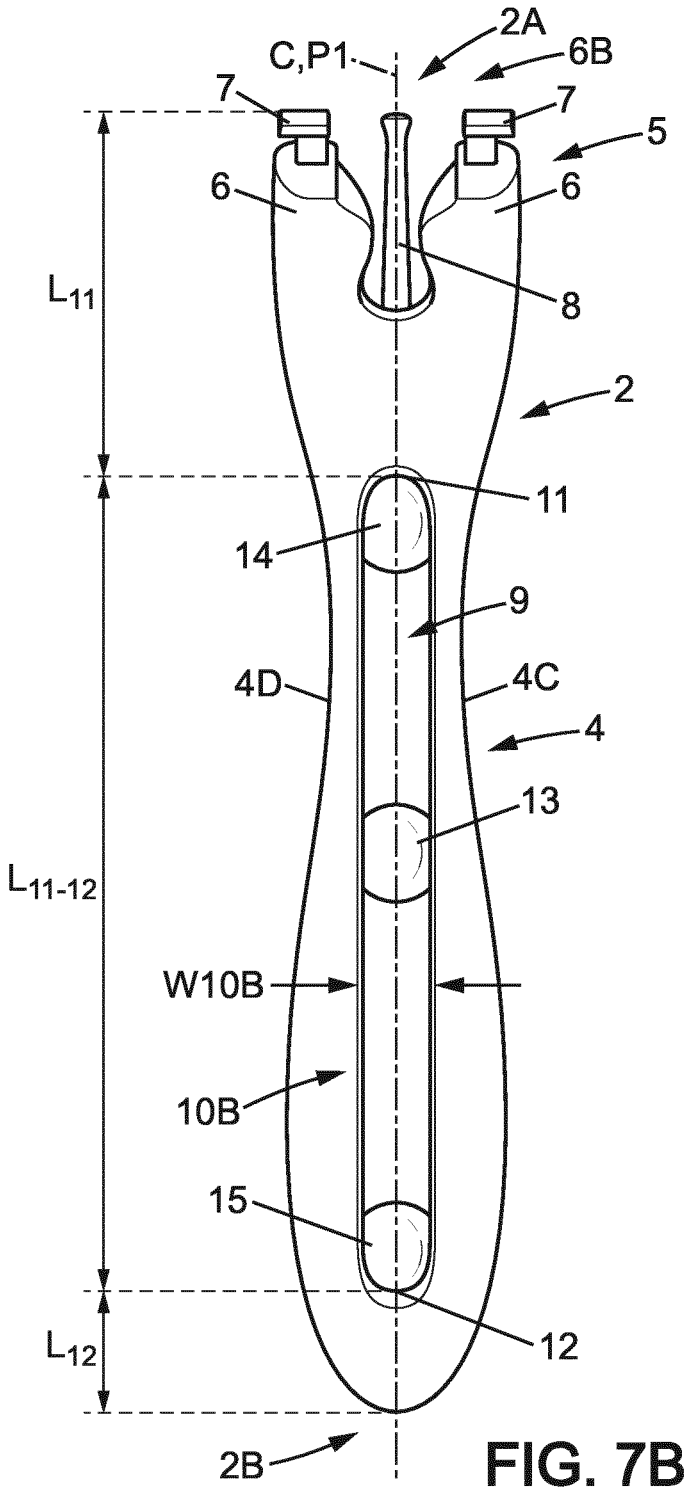

The lower part 9B comprises a second interior wall 9H extending in the longitudinal direction C. The second interior wall 9H is a straight wall which delimits an interior space of the lower part 9B of the cavity 9 comprised inside the elongated body 4 between the upper part 9A and the lower face 4B as illustrated on FIG. 5.

The razor handle 2 further comprises a first insert 13. The first insert 13 is preferably made of a material chosen among the metals, the plastics and the rubbers. The first insert 13 can also be made of other materials such as glass, wood and/or ceramic. In particular, the first insert 13 is preferably made of a rigid material. The first insert 13 can be of a material having a density that is significantly different from the density of the material of the elongated body 4.

For instance, the density of the first insert 13 may be greater than the density of the material of the elongated body 4. The first insert 13 thus contributes to raise the weight of the razor handle 2 without significantly increasing the volume of the razor handle 2.

As a consequence, the razor handle 2 can be heavy enough to provide a good shaving and to make sure that a good contact is provided between the blades 3A of the shaving cartridge 3 and the skin of the user to be shaved. Preferably, the first insert 13 is only made of metal and does not comprise any other material.

The first insert 13 may have a spherical shape. The first insert 13 may have an ovoid shape. More generally, the first insert 13 may have any other shape such as a parallelipipedic, cubical or cylindrical shape. Preferably, the first insert 13 is a single sphere. Preferably, the size of the first insert 13, in the direction perpendicular to the longitudinal direction C, is smaller than the size of the cavity 9 in this same perpendicular direction. In the case the first insert 13 is a sphere, the first insert 13 may have a diameter D13 measured in a direction perpendicular to the longitudinal direction C which is comprised between 40% and 80% of the smallest width W1 of the elongated body 4.

The first insert 13 is located within the upper part 30 9A of cavity 9. The first interior wall 9E of the upper part 9A may have different shapes. As illustrated on FIG. 5, the first interior wall 9E of the upper part 9A of the cavity 9 may have a shape that is partly complementary to the shape of the first insert 13. Also, the first insert 13 is partially encapsulated within the upper part 9A of the cavity 9. This prevents the first insert 13 from having any lateral displacement in a direction which is perpendicular to the longitudinal direction C. Besides, the first insert 13 is maintained within the cavity 9 and cannot therefore be detached from the razor handle 2 by a user. To this end, as illustrated on FIG. 2A, 2B, the opening 10A, 10B respectively have a width W10A, W10B which is smaller than the size of the first insert 13, and in particular of the diameter D13 of the first insert 13 when this first insert 13 is a sphere.

Preferably, less than 50% of the surface of the first insert 13 is encapsulated within the upper part 9A. In other words, the surface of the first insert 13 which is encapsulated cannot be directly touchable by the user as it is surrounded with the material of the elongated body 4. The first insert 13 can protrude from the outer face 4E of the elongated body 4 as illustrated on FIG. 3. Preferably, the first insert 13 can protrude from the upper face 4A.

The first insert 13 is freely movable within the interior space of the upper part 9A of the cavity 9. Also, the cavity 9 has a shape allowing the first insert 13 to move freely within the cavity 9 between the first and second ends 11, 12 of said cavity 9. By freely movable, it has to be understood that the first insert 13 is not attached to any damping means or shock absorber for instance that may restrain its movement within the cavity 9. It also has to be understood that the first insert 13 moves on its own or independently within the cavity 9.

Besides, it also means that the first insert 13 is movable according to the position of the razor handle 2. The first insert 13 can thus have a translation movement and/or a rotation movement within the upper part 9A of the cavity 9. For instance, in the case the first insert 13 is a sphere, the first insert 13 may slide and roll simultaneously within the upper part 9A of the cavity 9. According to this embodiment, the first interior wall 9E of the cavity 9 may be smooth so that the first interior wall 9E does not 10 prevent the first insert 13 from moving within the cavity 9.

In particular, the first interior walls 9E of the cavity 9 may comprise a layer of a second material different from the material of the elongated body 4, preferably chosen among the rubbers. This second material may thus facilitate the sliding movement of the first insert 13 within the upper part 9A of the cavity 9.

As being freely movable within the cavity 9, the first insert 13 has a position which can vary and which is comprised between the first and second ends 11, 12 along the longitudinal direction C. This position of the first insert 13 depends on the orientation of the razor handle 2.

Figure 8A:
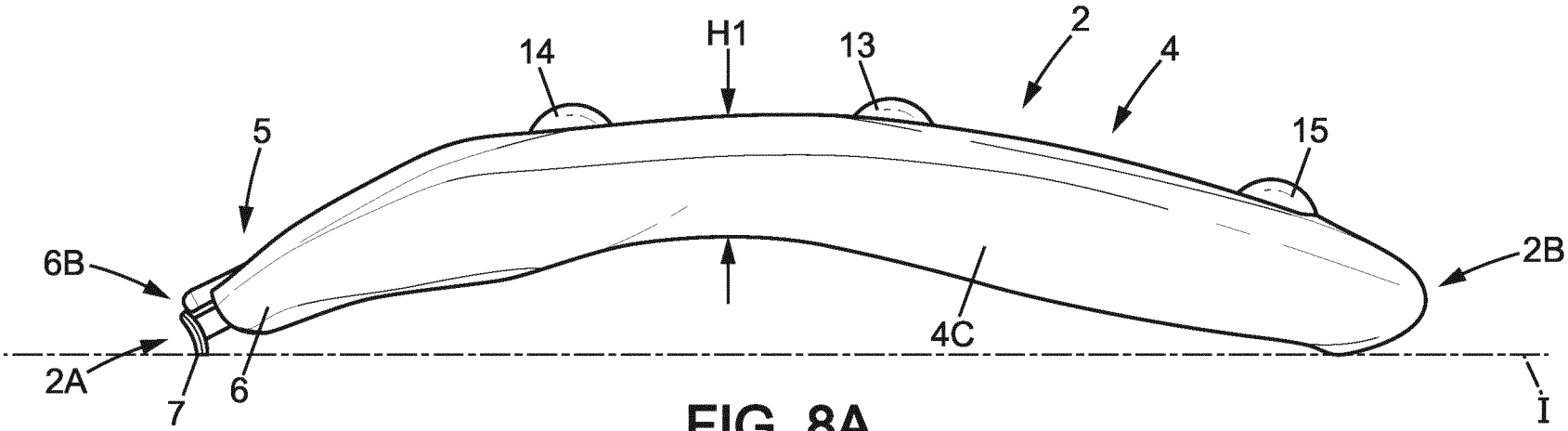
FIGS. 8A, 8B and 8C are side views of the razor handle of FIGS. 7A and 7B respectively in three different positions.
Figure 9:
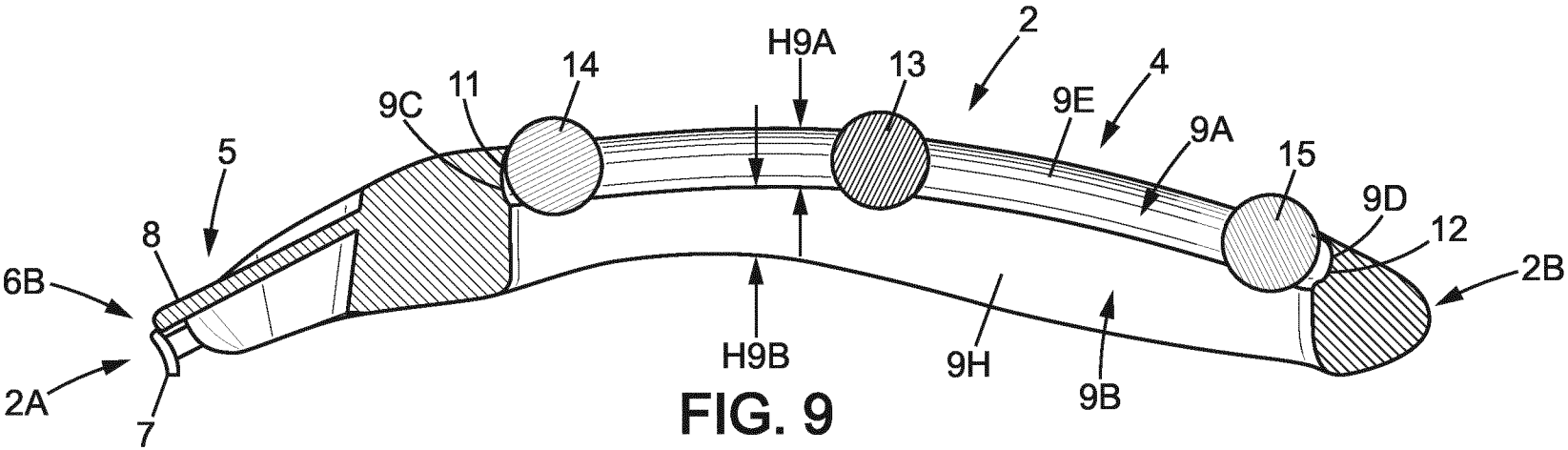
FIG. 9 is a section of the razor handle shown in FIG. 7A along line IX-IX.
Figure 8B:
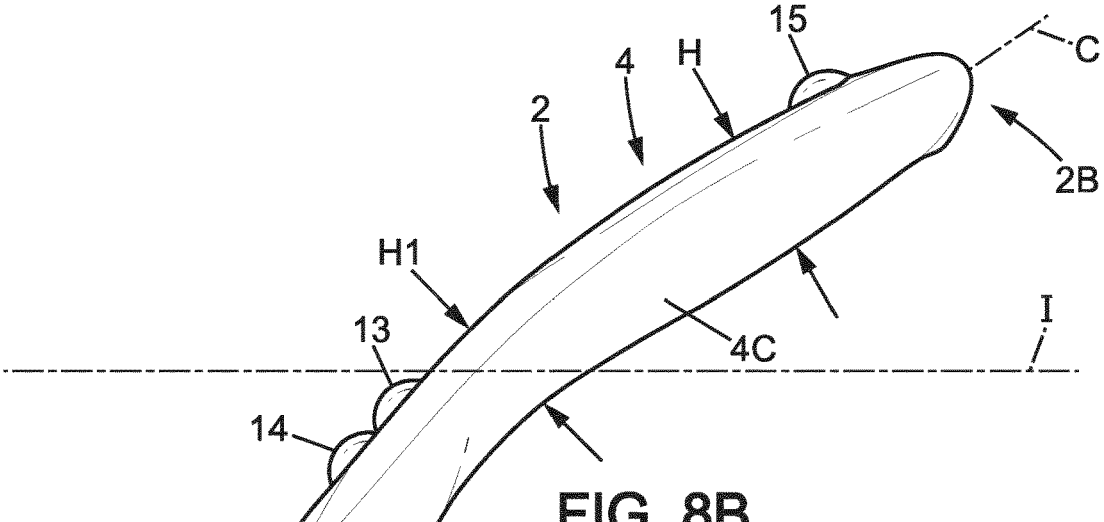
Figure 8C:
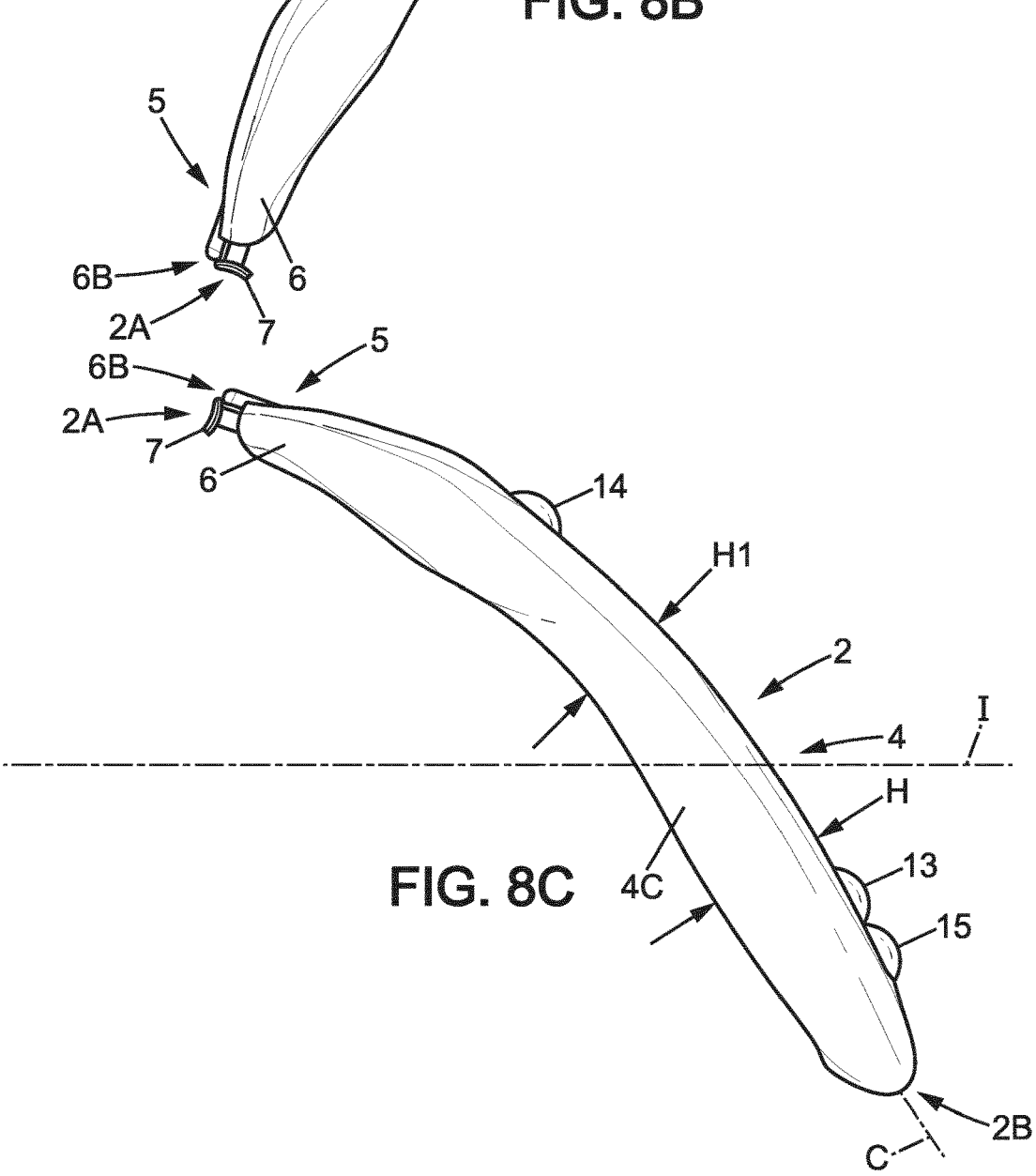
Figure 10:
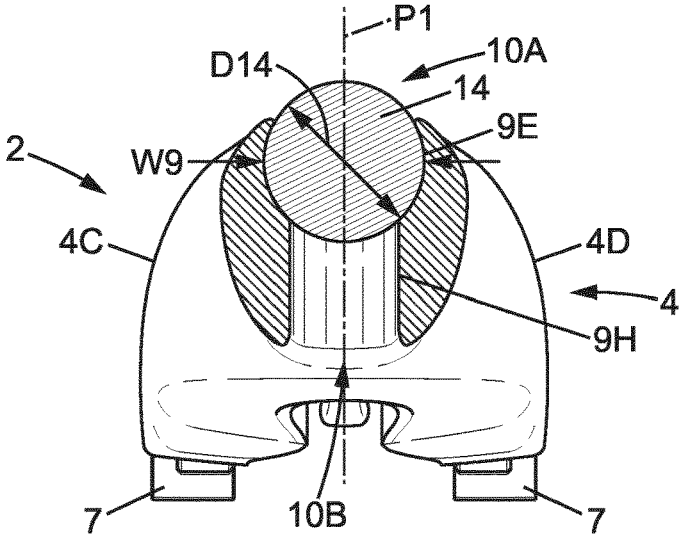
FIG. 10 is a section of the razor handle shown in FIG. 7A along line X-X.
Figure 11:
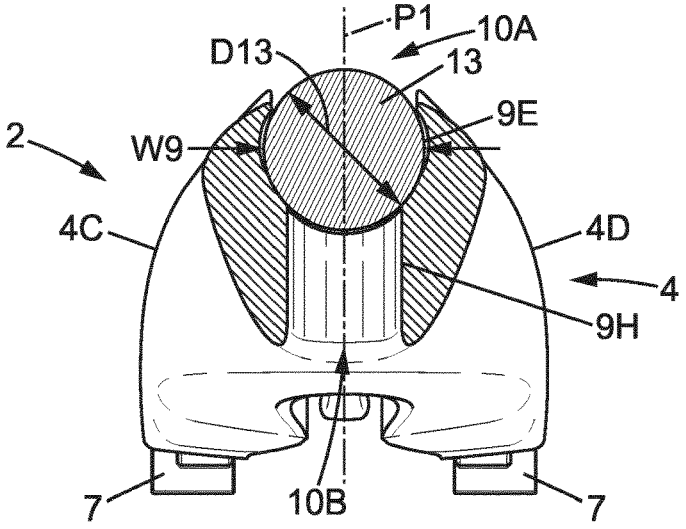
FIG. 11 is a section of the razor handle shown in FIG. 7A along line XI-XI.
Figure 12:
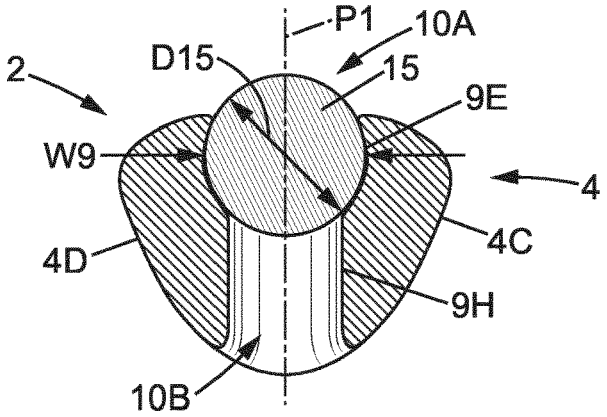
FIG. 12 is a section of the razor handle shown in FIG. 7A along line XII-XII.

The razor handle 2 defines a fixed straight horizontal line I when said razor handle 2 is placed on a flat horizontal surface. In this case, as illustrated on FIGS. 3A and 8A, this horizontal line I goes from the front end 2A to the rear end 2B of the razor handle 2. When the razor handle 2 is tilted, its inclination changes relative to the horizontal line I. More precisely, when the front end 2A is below the horizontal line I, the first insert 13 is located at the first end 11 as illustrated on FIG. 3B. In other words, the front end 2A is below the rear end 2B with respect to the horizontal line I. When the rear end 2B is below the horizontal line I, the first insert 13 is located at the second end 12 as illustrated on FIG. 3C. In other words, the rear end 2B is below the front end 2A with respect to the horizontal line I.

Also, due to gravity, the position of the first insert 13 changes. More precisely, the first insert 13 is located at the first end 11 when the user holds the razor handle 2 downwards (the shaving cartridge 3 being directed downwards) as illustrated on FIG. 1B. To the contrary, the insert 13 is located at the second end 12 when the user holds the razor handle 2 upwards (the shaving cartridge 3 being directed upwards) as illustrated on FIG. 1A. As a consequence, the center of balance of the razor handle 2 depends on its orientation. The insert 13 can also have any position between the first and second ends 11, 12, in particular while moving from the first end 11 to the second end 12 and vice versa. For instance, such an intermediate position between the first and second ends 11, 12 is illustrated on FIGS. 2A and 2B. It has to be understood that the first insert 13 may also have a position of equilibrium which is not in the first or second ends 11, 12. This may be the case for instance when the razor handle 2 is placed horizontally in a stable position.

As an alternative, the movement of the first insert 13 may not be imposed by gravity. In this case, the position of the first insert 13 may be chosen by the user, so that the first insert 13 has preferred fixed positions for instance.

In addition, the first interior wall 9E of cavity 9 may be provided with zones having more frictional zones may represent the majority of the first interior wall 9E of the cavity 9 or, to the contrary, may be only localized to one or several specific locations within the cavity 9. In these zones, the first insert 13 may not move, or may move more slowly than in the rest of the cavity 9, between the first and second ends 11, 12. According to this alternative, the first insert 13, when located in the zones having more frictional resistance, may therefore need to be pushed by the user to move within the cavity 9. According to a specific embodiment, the first insert 13 may have a small diameter D13 and may be movable within the cavity 9 only for fine adjustment of the weight of the razor handle 2. The distance L11-12, which corresponds to the length of the cavity 9, may be of about 10% of the length L of the razor handle 2 in the longitudinal direction C in cases where the razor handle 2 is suited for minor adjustability. One example of using this minor adjustability embodiment can be for precision trimming. To the contrary, according to another embodiment when the razor handle 2 is used for body shaving for instance, more adjustability may be needed. In this case, the distance L11-12 may be greater, for instance of about 90% of the length L of the razor handle 2 in the longitudinal direction C.

In a second embodiment illustrated on the FIGS. 6 to 25 12, the razor handle 2 may comprise a second insert 14 and a third insert 15.

Like the first insert 13, the second and third inserts 14, 15 may also move freely within the upper part 9A of the cavity 9. However, the second and third inserts 14, 15 preferably cannot move in any manner within the cavity 9. The second and third inserts 14, 15 can thus be fixedly maintained, advantageously secured, respectively at the first and second ends 11, 12 within the upper part 9A of the cavity 9 and can therefore not be detached by a user. As a consequence, the second and third inserts 14, 15 are not movable (i.e. immovable or motionless) relative to the cavity 9. More precisely, the second and third inserts 14, 15 cannot slide in the cavity 9 in order to change their positions within the cavity 9. In this second embodiment, only the first insert 13 moves freely towards either the second insert 14 or the third insert 15 within the upper part 9A of the cavity 9 depending on the orientation of the razor handle 2 as illustrated on FIGS. 6A and 6B. More precisely, the first insert 13 is in contact with the second insert 14 at the first end 11 when the user holds the razor handle 2 downwards (the shaving cartridge 3 being directed downwards) as illustrated on FIG. 6B. In this case, the front end 2A is below the horizontal line I as illustrated on FIG. 8B. To the contrary, the insert 13 is in contact with the third insert 15 at the second end 12 when the user holds the razor handle 2 upwards (the shaving cartridge 3 being directed upwards) as illustrated on FIG. 6A. In this case, the rear end 2B is below the horizontal line I as illustrated on FIG. 8C.

The first, second and third inserts 13, 14, 15 can be directly touchable by a user. Also, the non-movable second and third inserts 14, 15 thus form finger rest areas. In this manner, when a user wants to shave, he may position his fingers on the second and third inserts 14, 15, and preferably on the surfaces of the second and third inserts 14, 15 which are not encapsulated in the cavity 9.

Preferably, the second and third inserts 14, 15 enhance hand grasping in certain shaving positions, such as in a position where the razor handle 2 is held between the index and the thumb, the thumb resting on the second insert 14 on the upper face 4A. In another shaving position, the thumb and the index of the user can also rest on the third insert 15. In particular, the first, second and third inserts 13, 14, 15 can protrude from the outer face 4E of the razor handle 2.

The second and/or third inserts 14, 15 may not move on itself. In other words, the second and/or third inserts 14, 15 cannot slide or rotate on itself. However, according to another alternative of the invention, the second and/or third inserts 14, 15 may also be movable relative to its position. The material and the surface finish of the second insert 14 and/or third insert 15 is adapted to allow this movability, especially by rotation. For instance, the second insert 14 and/or third insert 15 may be a sphere that can rotate on itself about its own axis in all directions.

However, a user that may position one of his fingers on such a movable second insert 14 and/or third insert 15 will find difficult to shave as his finger(s) will constantly slip on the second insert 14 and/or third insert 15. Shaving will therefore be imprecise and uncomfortable. As a consequence, when the second insert 14 or the third insert 15 is movable, it cannot form fingers rest areas.

More precisely, when the second insert 14 is movable, it cannot be a finger rest area. Besides, the second insert 14 and/or third insert 15, even when movable, is not detachable from the razor handle 2.

The second and third inserts 14, 15 may be made of the 30 same material as the first insert 13 or may be made of a different one. For instance, the first insert 13 may be made of metal whereas the second and third inserts 14, 15 may be made of rubber or vice versa.

Besides, each of the first, second and third inserts 13, 14, 15 can also be made with several materials. In particular, the first, second and third inserts 13, 14, 15 can be covered with a layer of another material having a smooth surface. As an example, the first, second and third inserts 13, 14, 15 may be made of metal. The first, second and third inserts 13, 14, 15 can be covered by a layer of rubber. In this embodiment, the layer can have a surface finish comprised between 0.5 μm and 1.6 μm (roughness Ra).

The first and/or second and/or third inserts 13, 14, 15 may also have an irregular surface, for instance with craters or bumps due to a knurled pattern or a divot pattern. As a matter of fact, the type of surface of the second and third inserts 14, 15 affect the tactile sensing of the user when he positions his fingers on the second and third inserts 14, 15.

The material chosen may also have an impact on the sensing experience of the user when he positions his fingers on the second and/or third inserts 14, 15. As an example, an insert made of metal provides a pin-point contact with the fingers of the user, thus allowing the communication of all transmitted vibrations from shaving.

To the contrary, an insert made of rubber, such as thermoplastics, absorbs most of the vibrations from shaving and does not transmit them to the fingers of the user.

As another alternative, the first, second and third inserts 13, 14, 15 may have the same shape or may have a 30 different one.

As depicted on the figures, each of first, second and third inserts 13, 14, 15 is preferably a single sphere.

According to this embodiment, the first, second and third inserts 13, 14, 15 have respectively diameters D13, D14, D15 that can be the same. However, each of the first, second and third inserts 13, 14, 15 may have different diameters D13, D14, D15. The second and third inserts 14, 15 may both have a diameter D14, D15 which is greater than the diameter D13 of the first insert 13. In particular, diameters D14, D15 of second and third inserts 14, 15 may correspond to the diameters D11, D12 of the semi-spherical shapes 9C, 9D of the first interior wall 9E. In this way, the second and third inserts 14, 15 remain maintained at the first and second ends 11, 12 of the cavity 9 whereas the first insert 13 can still move freely within the cavity 9. The first, second and third inserts 13, 14, 15 are spheres which have respectively a diameter D13, D14, D15 measured in a direction perpendicular to the longitudinal direction C which is comprised between 40% and 90% of the smallest width W1 of the elongated body 4. For instance, the smallest width W1 may be of about 13 mm whereas the diameter D13 of the first insert 13 may be of about 10 mm and the diameters D14, D15 of the second and third inserts 14, 15 may be of about 12 mm.

The first, second and third inserts 13, 14, 15 preferably are each a metal sphere. As another alternative, the first, second and third inserts 13, 14, 15 may be spheres having one hemisphere made of rubber and the other hemisphere made of plastic. Besides, each of the first, second and third inserts 13, 14, 15 may not be a complete sphere. Each of the first, second and third inserts 13, 14, 15 may only comprise a partial curved surface, especially a partial spherical surface.

The inclusion of first, second and third inserts 13, 14, 15 within the cavity 9 does not lead to an excessive deformation of the shape of the elongated body 4. Besides, the shape of the elongated 4 preferably remains similar to the shape of an elongated body that would not include any insert.

Due to the first, second and third inserts 13, 14, 15, the elongated body 4 can be in a material which is lighter and cheaper when compared to the material used in known razor handles. Nevertheless, despite the lightness of the material, the razor handle 2 still has a good quality appearance and an optimized weight. Besides, the weight of the razor handle 2 is chosen to be localized in the front end 2A or in the rear end 2B of the razor handle 2, thus ensuring a good balance at all time of the razor handle 2. As a consequence, the movement of the inserts thus changes the center of weight of the razor handle 2.

The invention claimed is:

1. A razor handle comprising:

an elongated body including a cavity and a first insert, the elongated body defining a longitudinal axis and including a first portion and a second portion;

the first portion having a first outer surface and a first interior wall delimiting an interior space of the first portion and defining a first part of the cavity, and the second portion having a second outer surface and a second interior wall delimiting an interior space of the second portion and defining a second part of the cavity, the second outer surface being opposite the first outer surface;

the first part of the cavity opening on the first outer surface and the second part of the cavity opening on the second outer surface, the first part of the cavity being in communication with the second part of the cavity such that the cavity extends transverse to the longitudinal axis of the elongated body through the elongated body and opening on the opposing second outer surface of the elongated body;

the first insert being disposed only in the first part of the cavity;

the first interior wall of the elongated body being shaped to complement a shape of the first insert; and the first insert being configured to move independently and freely within the first part of the cavity between a first end and a second end of the first part of the cavity upon movement of the elongated body during shaving.

2. The razor handle according to claim 1, wherein a position of the first insert is dependent upon how the razor handle is oriented.

3. The razor handle according to claim 1, wherein the elongated body is a unitary element which comprises a material chosen among plastics, metals, and rubbers.

4. The razor handle according to claim 1, wherein the first insert is made of rigid material having a density that is different from a density of a material of the elongated body.

5. The razor handle according to claim 1, wherein the first insert comprises a material chosen among metals, plastics, and rubbers.

6. The razor handle according to claim 1, wherein the first part of the cavity extends along the longitudinal axis, between the first end and the second end and defines a length measured along the longitudinal axis between 10% and 90% of a length of the elongated body disposed at the center of the elongated body.

7. The razor handle according to claim 1, wherein the elongated body includes a center disposed between a first end and a second end of the elongated body, the center having a width smaller than a width of the first end and second end of the elongated body; a width of the first part of the cavity being between 50% and 80% of the smaller width of the elongated body disposed at the center of the elongated body.

8. The razor handle according to claim 1, wherein a first end of the elongated body is provided with a connecting mechanism for connection to a shaving cartridge; the first end of the first part of the cavity and a first end of the second part of the cavity is disposed proximate to the first end of the elongated body, and the second end of the first part of the cavity and a second end of the second part of the cavity is disposed proximate to a second end of the elongated body.

9. The razor handle according to claim 8, wherein the first end of the first part of the cavity is located at a distance measured along the longitudinal axis from the first end of the elongated body between 5% and 30% of a length of the elongated body defined between the first end and the second end of the elongated body.

10. The razor handle according to claim 8, wherein the second end of the second part of the cavity is located at a distance measured along the longitudinal axis from the second end of the elongated body between 5% and 15% of a length of the elongated body defined between the first end and the second end of the elongated body.

11. The razor handle according to claim 1, wherein the elongated body includes a center disposed between a first end and a second end of the elongated body, the center having a width smaller than a width of the first end and second end of the elongated body; the first insert is a sphere having a diameter measured in a direction perpendicular to the longitudinal axis of between 40% and 80% of the smaller width of the elongated body disposed at the center of the elongated body.

12. The razor handle according to claim 1, wherein the elongated body includes a center disposed between a first end and a second end of the elongated body, the center having a width smaller than a width of the first end and second end of the elongated body; the first end and the second end of the first part of the cavity is semi-spherically shaped and having a diameter measured in a direction perpendicular to the longitudinal axis of between 40% and 80% of the smaller width of the elongated body disposed at the center of the elongated body.

13. The razor handle according to claim 1, wherein the first part of the cavity that opens on the first outer surface of the elongated body has a width defined in a direction perpendicular to the longitudinal axis, the width being smaller in size than a size of the first insert.

14. A razor comprising a razor handle according to claim 1 and including a shaving cartridge connected to the elongated body of the razor handle.

15. The razor handle according claim 1, wherein a height of the first part of the cavity, is constant along a length of the first part of the cavity; and a height of the second part of the cavity, defined between the second outer surface of the elongated body and the first part of the cavity, varies along a length of the second part of the cavity.

16. The razor handle according to claim 15, wherein the first interior wall of the first part of the cavity is smooth.

17. The razor handle according to claim 15, wherein the first insert is partially encapsulated by the first interior wall within the first part of the cavity such that the elongated body surrounds the first insert.

18. The razor handle according to claim 1, wherein the razor handle includes a second insert and a third insert, the shape of the first interior wall being partly complementary to a shape of the second and third inserts, the second and third inserts being disposed within the first part of the cavity, respectively, in the first and second ends of the first part of the cavity such that the second insert is partially encapsulated by the first interior wall within the first end of the first part of the cavity and the third insert is partially encapsulated by the first interior wall within the second end of the first part of the cavity.

19. The razor handle according to claim 18, wherein the second insert is immovable within the first part of the cavity, the immovable second insert being suitable for a finger rest area.

20. The razor handle according to claim 18, wherein the second insert is configured to be movable along the partly complementary shape of the first interior wall of the first part of the cavity upon movement of the elongated body during shaving.

21. The razor handle according to claim 18, wherein the third insert is immovable within the first part of the cavity, the immovable third insert being suitable for a finger rest area.

22. The razor handle according to claim 18, wherein the first, second, and third inserts are spheres which each have a diameter measured in a direction perpendicular to the longitudinal axis of between 40% and 90% of a smallest width of the elongated body.

23. The razor handle according to claim 22, wherein the second and third inserts each have a diameter which is greater than the diameter of the first insert.

24. A razor handle comprising:

an elongated body including a cavity and a first insert, the elongated body defining a longitudinal axis and including a first portion and a second portion;

the first portion having a first outer surface and a first interior wall delimiting an interior space of the first portion and defining a first part of the cavity, and the second portion having a second outer surface and a second interior wall delimiting an interior space of the second portion and defining a second part of the cavity, the second outer surface being opposite the first outer surface;

the first part of the cavity opening on the first outer surface and the second part of the cavity opening on the second outer surface, the first part of the cavity being in communication with the second part of the cavity such that the cavity extends transverse to the longitudinal axis of the elongated body through the elongated body and opening on the opposing second outer surface of the elongated body;

the first insert being disposed only in the first part of the cavity;

the first interior wall of the elongated body being shaped to complement a shape of the first insert; and the first interior wall of the first part of the cavity including zones having varying frictional resistance between the first insert and the first interior wall of the first part of the cavity, the zones varying frictional resistance thereby limiting movement of the first insert within the first part of the cavity.

* * * * *